US007025834B2

(12) United States Patent
Joynt et al.

(10) Patent No.: US 7,025,834 B2
(45) Date of Patent: Apr. 11, 2006

(54) RETRACTABLE BROOM AND DUST SKIRT

(75) Inventors: Daniel L. Joynt, Wyoming, MN (US); Ronald W. Lehman, Rogers, MN (US); Larry D. Wydra, Plymouth, MN (US)

(73) Assignee: Tennant Company, Minneapolis, MN (US)

( * ) Notice: Subject to any disclaimer, the term of this patent is extended or adjusted under 35 U.S.C. 154(b) by 276 days.

(21) Appl. No.: 10/235,965

(22) Filed: Sep. 4, 2002

(65) Prior Publication Data

US 2004/0040104 A1 Mar. 4, 2004

(51) Int. Cl.
*E01H 1/08* (2006.01)

(52) U.S. Cl. ..... 134/21; 15/340.4

(58) Field of Classification Search ..... 15/340.1, 15/340.2, 340.3, 340.4, 347, 78, 82–87; 134/6, 134/21

See application file for complete search history.

(56) References Cited

U.S. PATENT DOCUMENTS

| | | | | |
|---|---|---|---|---|
| 501,353 | A | 7/1893 | Myers | |
| 1,015,637 | A | 1/1912 | Roby | |
| 1,244,009 | A | 10/1917 | Altenberg | |
| 2,018,791 | A | 10/1935 | Kern | |
| 3,008,542 | A | 11/1961 | Steele | |
| 3,234,576 | A | 2/1966 | Lyon | |
| 3,436,788 | A * | 4/1969 | Simon | 15/385 |
| 3,604,051 | A | 9/1971 | Wendel et al. | |
| 3,634,903 | A | 1/1972 | Larsen | |
| 3,639,940 | A | 2/1972 | Carlson et al. | |
| 3,756,416 | A | 9/1973 | Wood | |
| 3,792,569 | A | 2/1974 | Carlson et al. | |
| 3,825,968 | A * | 7/1974 | Larsen | 15/87 |
| 3,881,215 | A | 5/1975 | Krier et al. | |
| 3,926,596 | A | 12/1975 | Coleman | |
| 4,017,281 | A | 4/1977 | Johnstone | |
| 4,317,246 | A | 3/1982 | Knowlton | |
| 4,578,840 | A | 4/1986 | Pausch | |
| 4,660,248 | A | 4/1987 | Young | |
| 4,729,141 | A | 3/1988 | Berg et al. | |
| 4,754,521 | A * | 7/1988 | Zoni | 15/340.1 |
| 4,759,781 | A | 7/1988 | Olson | |
| 4,817,233 | A | 4/1989 | Waldhauser | |
| 5,006,136 | A | 4/1991 | Wetter | |
| 5,125,128 | A | 6/1992 | Davis | |
| 5,249,332 | A * | 10/1993 | Wilkerson | 15/384 |
| 5,394,586 | A | 3/1995 | Holley | |

(Continued)

FOREIGN PATENT DOCUMENTS

| | | |
|---|---|---|
| DE | 1253242 | 12/1967 |

(Continued)

*Primary Examiner*—Terrence R. Till
(74) *Attorney, Agent, or Firm*—Altera Law Group, LLC

(57) ABSTRACT

A gutter broom assembly for a street sweeper and method of use are disclosed. The invention relates to street sweeper having a vacuum system for moving air through a portion thereof and having a gutter broom assembly. The gutter broom assembly includes housing, a gutter broom being movable between an operational orientation and a transport orientation relative to the housing, and a skirt assembly attached to the housing. A sweeping chamber is defined within the housing and the skirt assembly which substantially encloses the gutter broom. A vacuum connection between the sweeping chamber and the vacuum system is provided for removing dust within the sweeping chamber when the gutter broom frame is in its operational orientation.

14 Claims, 4 Drawing Sheets

U.S. PATENT DOCUMENTS

| | | | | |
|---|---|---|---|---|
| 5,659,921 | A | 8/1997 | Narayan | |
| 5,991,953 | A | 11/1999 | Durenberger et al. | |
| 6,018,844 | A | 2/2000 | Basham et al. | |
| 6,070,290 | A * | 6/2000 | Schwarze et al. | 15/340.1 |
| 6,073,295 | A | 6/2000 | Durenberger et al. | |
| 6,192,542 | B1 | 2/2001 | Frederick et al. | |
| 6,195,836 | B1 | 3/2001 | Vanderlinden | |
| 6,195,837 | B1 | 3/2001 | Vanderlinden | |
| 2004/0020003 | A1 * | 2/2004 | Strauser | 15/340.3 |

FOREIGN PATENT DOCUMENTS

| | | |
|---|---|---|
| DE | 1256241 | 12/1967 |
| EP | 0453177 | 4/1991 |
| WO | 03/069071 | 2/2003 |

* cited by examiner

RETRACTABLE BROOM AND DUST SKIRT

FIELD OF THE INVENTION

The invention relates to a surface maintenance machine, such as a sweeping machine, for cleaning an area such as a street, factory floor, hallway, or other surfaces.

BACKGROUND OF THE INVENTION

A variety of surface maintenance machines are known to those of ordinary skill in the art. Examples of such machines include large street sweepers, and smaller floor sweepers or scrubbers, or a combination thereof. Such machines typically include a brush for engaging debris upon the floor surface and a vacuum system for assisting in the recovery of debris from the floor surface. It is also known in the art to utilize a rotary brush with a flexible surface engaging skirting, such as disclosed in U.S. Pat. Nos. 5,659,921; 5,991,953; and 6,073,295, each being incorporated by reference herein. The brush and skirting may be used in association with a vacuum system to contain some of the dust associated with the brush. The skirting may be retractable relative to the brush, such as disclosed in U.S. Pat. No. 5,125,128.

Generally, conventional street sweepers and the like use at least one and preferably two side rotary brushes and a rotating broom which sweep pavement or other surfaces to remove debris and clean the surface. As the sweeper passes over the surface to be cleaned, the side brushes dislodge and sweep the debris such as dirt, leaves, gravel and the like between the wheels and toward the machine center. A debris windrow may be formed along the longitudinal axis of the sweeper. The rotating broom conveys the debris into a collection hopper. Many modern street sweepers not only sweep debris with the broom, but also have on-board storage adjacent the broom where debris swept by the broom can be picked up and removed for disposal.

Unfortunately, such street sweepers have several disadvantages. One problem with side or gutter brooms is that not all the debris ends up in the windrow. Depending on the debris type, some particles may be thrown clear by the brush. Additionally, brush-transported dust and debris often creates an objectionable airborne dust cloud. In residential areas the creation of a dust cloud may be especially objectionable.

SUMMARY OF THE PRESENT INVENTION

The present invention addresses the problem of dusting and relates to a retractable gutter broom and gutter broom housing for use with a surface maintenance machine. The gutter broom housing of the present invention functions as a barrier that keeps debris from being thrown clear of the sweeper by the action of the side broom. Additionally, the gutter broom housing includes a skirt which functions as a barrier to prevents airborne dust from escaping from the gutter broom housing.

A vacuum can be applied within a sweeping chamber formed by the gutter broom housing to remove at least some, if not most or all, of the dust generated by the sweeping action of the gutter broom. An air filtration system may be associated with the vacuum to filter air prior to venting.

Yet another aspect of the invention is the provision that the gutter broom assembly can be raised off of the ground during a transport mode of operation. Additionally, the flexible skirt may be moved away from the ground surface during the transport mode to prevent unnecessary skirt wear.

One object of the present invention is to provide a retractable gutter broom assembly for a surface maintenance machine, such as a sweeper, the gutter broom being retractable when the surface maintenance machine is in a transport-only mode.

Another object of the invention is to provide a retractable gutter broom assembly for a surface maintenance machine having a vacuum outlet in communication with the gutter broom assembly for removing dust from within the sweeping chamber.

Another object of the present invention is to provide a surface maintenance machine, such as a street sweeper, having increased effectiveness and efficiency which would provide better collection of debris from a street or surface.

A further object of the present invention is to provide an improved and more efficient street sweeper which minimizes the creation of a dust cloud during operation A related object is to provide an improved machine which minimizes noise and increases efficiency.

Still another object of the present invention is to provide combine gutter brush assembly which may be efficiently manufactured using minimal components and efficient shapes.

The invention will be described in connection with a machine which has primarily sweeping functions. The concepts disclosed are equally applicable to a machine which only scrubs or both scrubs and sweeps. It is broadly directed to a surface maintenance machine.

These and other features and advantages of the invention will be more readily apparent upon reading the following description of a preferred exemplified embodiment of the invention and upon reference to the accompanying drawings.

BRIEF DESCRIPTION OF THE DRAWINGS

Preferred embodiments of the invention will be described in detail hereinafter with reference to the accompanying drawings, in which like reference numerals refer to like elements throughout.

DETAILED DESCRIPTION OF PREFERRED EMBODIMENTS

Figure 1:
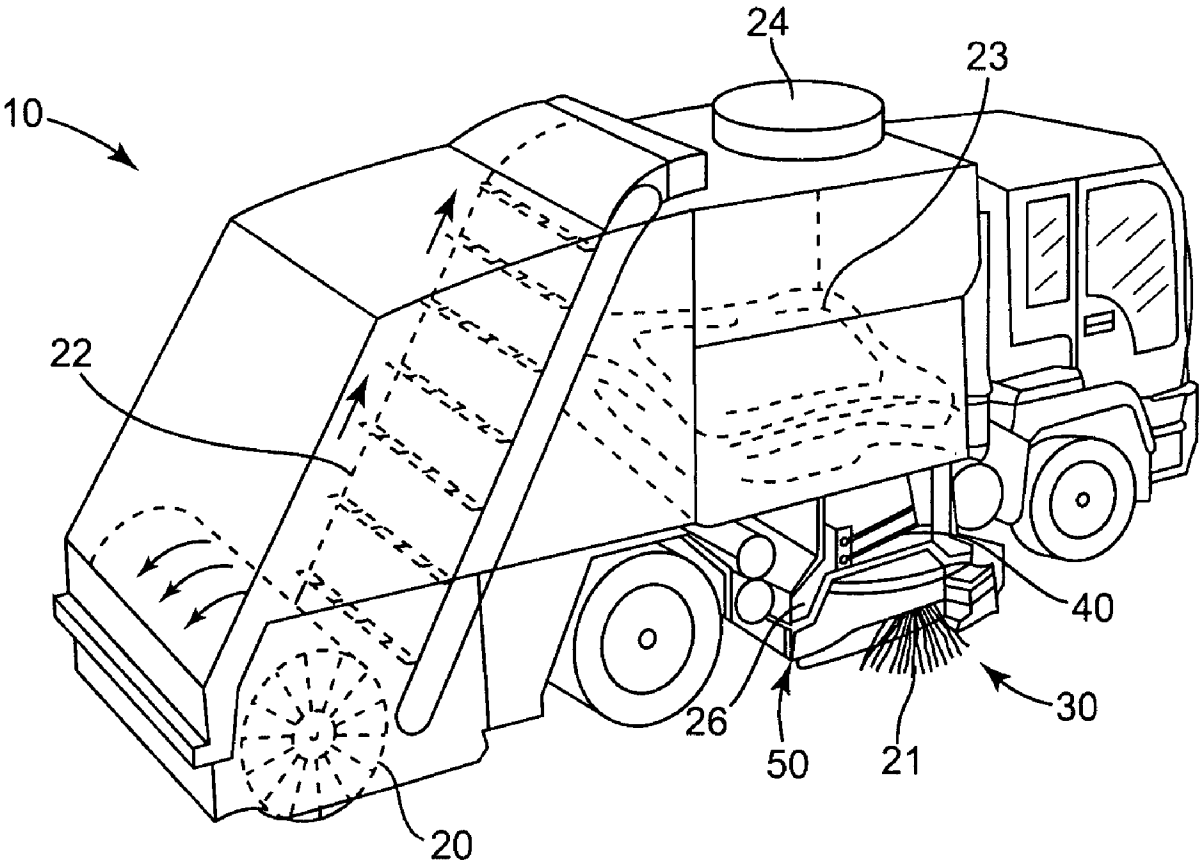
FIG. 1 is an elevational side view of an exemplary self-propelled surface maintenance vehicle employing an embodiment of the present invention.

A surface maintenance machine of the present invention is shown in FIG. 1. This surface maintenance apparatus may be used for sweeping and/or scrubbing floors in factories, warehouses, streets, and other industrial or commercial establishments. As shown in FIG. 1, a riding-type surface maintenance vehicle, such as a street sweeper 10, comprises a variety of elements such as brooms, a vacuum system, and a conveyor for transporting debris to a hopper 23.

Referring to FIG. 1, sweeper 10 comprises a main pickup broom 20, gutter broom assembly 30, a conveyor 22, a debris collection hopper 23, and a vacuum system 24. In this embodiment, pickup broom 20 as shown is a cylindrical broom and is attached to the rear of the sweeper 10. Broom 20 engages debris on the surface and directs it onto the conveyor 22. Conveyor 22 transports the debris to the top of hopper 23. In this embodiment, the hopper 23 is located forward of the conveyor 22.

Figure 4:
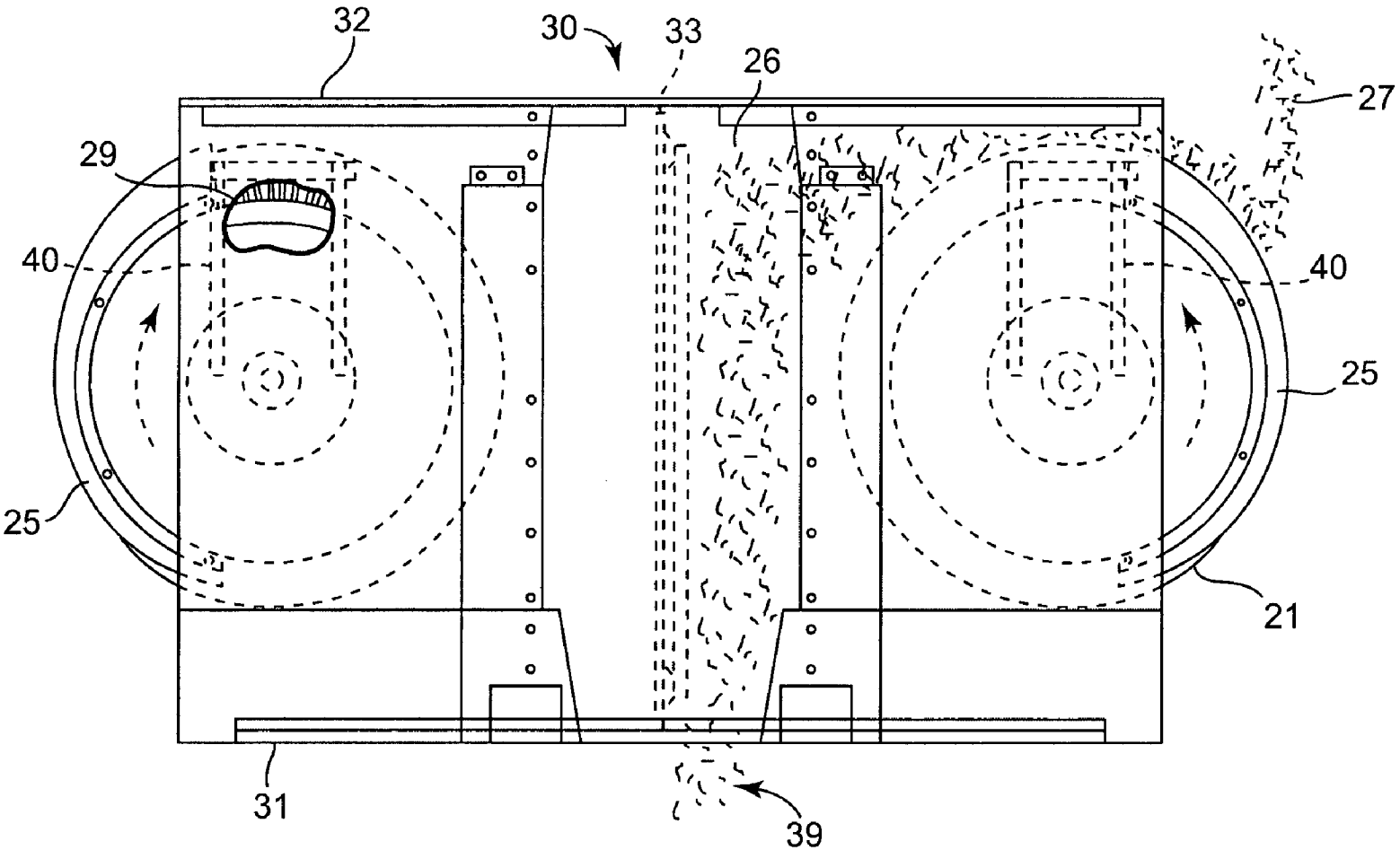
FIG. 4 is a top view taken along line 4—4 of FIG. 3.

The gutter or side broom assembly 30 comprises a broom housing 26, a skirt assembly 50, and a gutter broom 21. The gutter broom 21 can extend transversely from the direction of motion of sweeper 10 to reach and clean a street gutter or other area beyond the reach of main pickup broom 20. Additionally, as further described herein gutter broom 21 may be lifted away from the ground surface during a transport mode of operation and subsequently lowered into ground engagement during an operational mode. As depicted in FIG. 4, gutter broom 21 directs debris 27 toward the machine center creating a windrow 39 of debris 27.

Broom housing 26 is coupled to vehicle 10. Broom housing 26 together with skirt assembly 50 define a sweeping chamber during operation, the function and utility of which are described hereinafter. Skirt assembly 50 includes a plurality of flexible skirts 31–33 which are selectively movable relative to broom housing 26. As described herein, skirts 31–33 are selectively movable relative to the ground surface between a transport orientation and an operational orientation.

Vacuum system 24 is utilized to control dust generated by the operation of broom 20. Vacuum system 24 may preferably include an air filtration system(not shown) to remove dust particles prior to venting. A vacuum conduit 29 is coupled between gutter broom assembly 30 and vacuum system 24.

Figure 2:
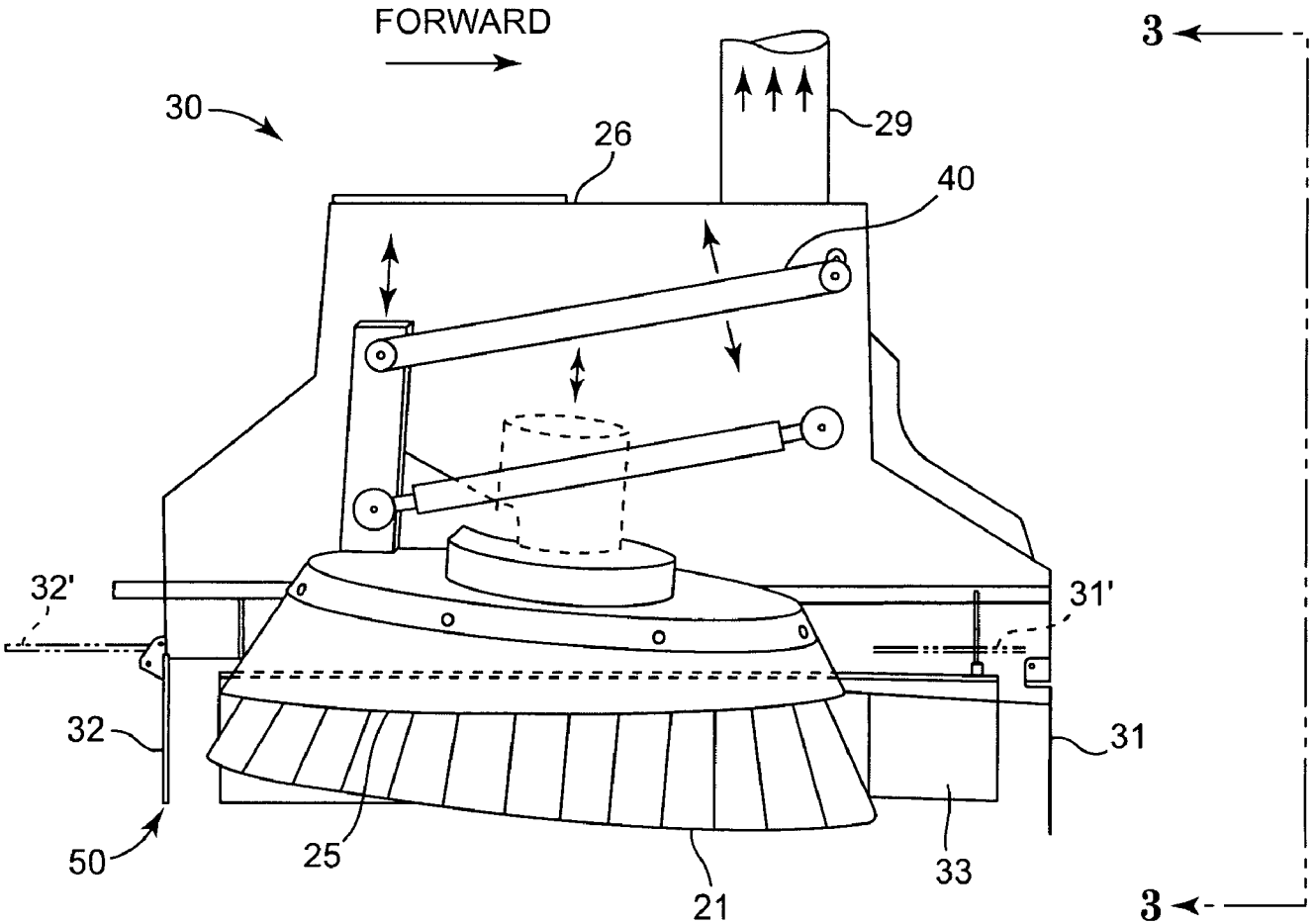
FIG. 2 is a side view of one embodiment of the gutter broom assembly of the present invention.
Figure 3:
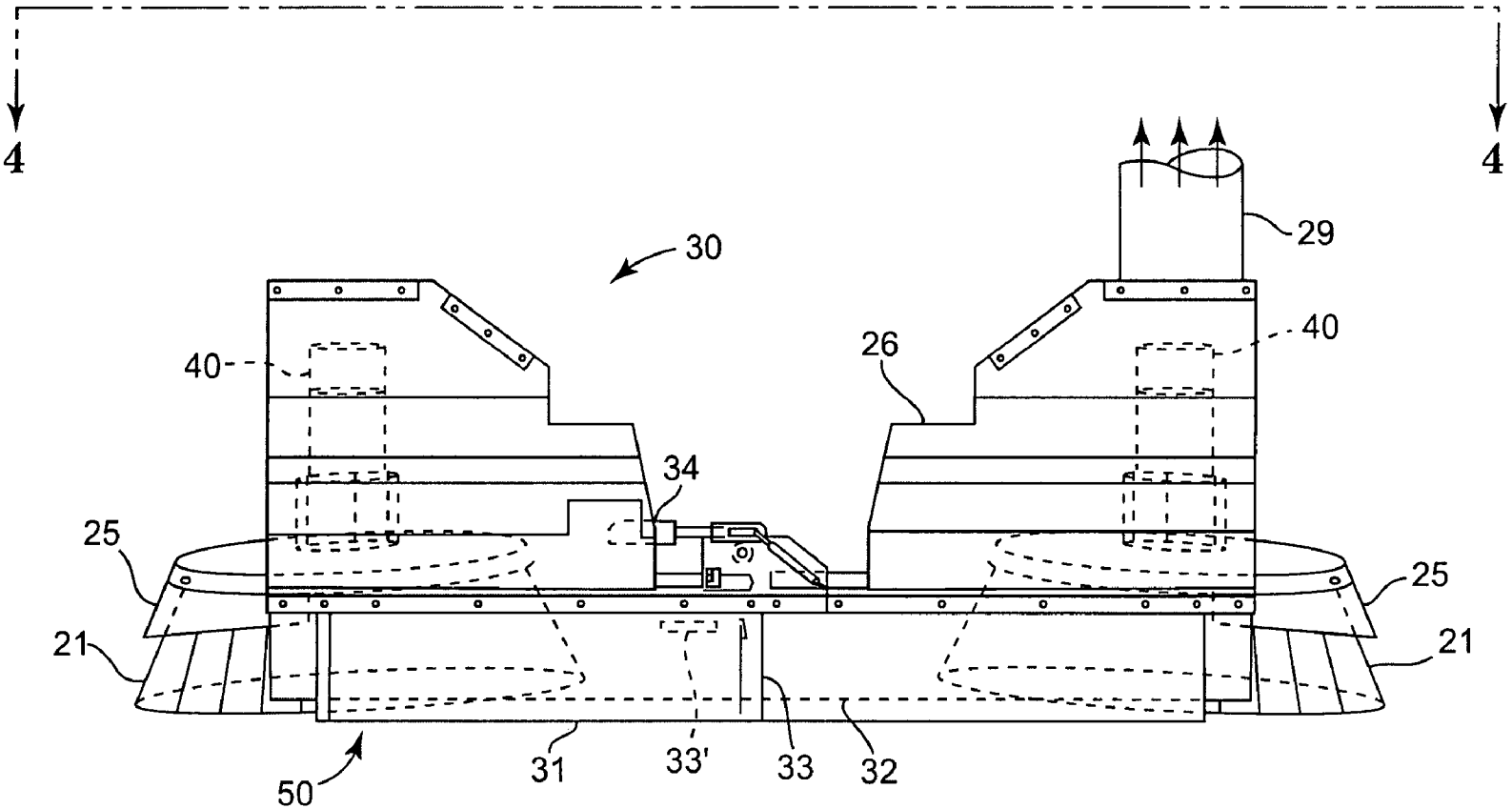
FIG. 3 is a front view taken along line 3—3 of FIG. 2.

FIGS. 2–4 present details of the gutter broom assembly 30. The skirt assembly 50 comprises front skirt 31, rear skirt 32, middle skirt 33, and side skirts 25. As seen in the embodiment shown in FIG. 4, side skirt 25 partially encircles gutter or side broom 21, so that skirts 25, in combination with front skirt 31, middle skirt 33, and rear skirt 32, create an enclosure preventing dust-laden air from exiting the sweeping chamber defined by housing 26 and skirt assembly 50. Front skirt 31, middle skirt 33, and rear skirt 32 are each retractable by operation of a hydraulic actuator 34 and associated linkages as shown in FIG. 3. In this illustrated embodiment, skirts 31, 32, 33 are pivotally secured to housing 26 and are selectively rotated away from the ground as depicted in FIGS. 2 and 3 by numerals 31', 32', 33' during a transport mode of operation to minimize skirt wear and other damage by ground contact. The retractable feature of skirts 31, 32, 33 may also be utilized for clearing large debris or ease of access to the gutter brooms during cleaning or maintenance. Those of ordinary skill in the art will appreciated that devices other than hydraulic actuator 34 and associated linkages may be used to selectively retract skirts 31–33 away from the ground surface.

Referring to FIG. 2, skirt assembly 50 and housing 26 encompass a substantial portion of gutter broom 21 and serve two functions. First, skirt assembly 50 functions as a barrier to stop debris from being thrown clear of the sweeper by the action of gutter broom 21. Second, skirt assembly 50 functions as a barrier to prevent dust clouding generated by the operation of gutter broom 21.

In sweeper 10 transit, gutter broom 21 is selectively retracted away from ground surface contact by 4-bar link 40 to prevent unnecessary wear. As described above skirts 31–33 are also retracted away from the ground surface to prevent unnecessary wear. 4-bar link 40 is connected to a suitable lifting device (not shown), such as a linear actuator, hydraulic cylinder, etc., to selectively lift gutter broom 21 away from the ground surface. FIGS. 1 and 2 provide gutter broom housing 26 with a side portion removed to illustrate linkage 40.

As described, skirt assembly 50 and housing 26 substantial enclose gutter broom 21 and define a sweeping chamber therewithin. Vacuum system 24 is coupled to the sweeping chamber via vacuum conduit 29 to contain and remove dust within housing 26 during operation. Vacuum system 24 may be coupled to housing 26 via one or more apertures opening into the sweeping chamber. Vacuum level within housing 26 is maintained at a level sufficient to remove dust from the sweeping chamber and to minimize the occurrence of dust clouding during operation. The vacuum force maintains a lower-than-ambient pressure in the sweeping chamber, which creates a flow of ambient external air into the sweeping chamber from underneath skirts 25, 31, 32 and 33. This air flow of air prevents the broom-generated dust-laden air from exiting the sweeping chamber. The air flow generated by the vacuum is sufficiently capable of transporting dust-laden air. Dust-laden air generated by gutter broom 21 is therefore efficiently contained and removed through the vacuum conduit 29.

Additional advantages and modifications will readily occur to those skilled in the art upon reflection on the teaching, written disclosure and illustrations herein. The invention in its broader aspects is, therefore, not limited to the specific details, representative apparatus and illustrative examples shown and described. Accordingly, departures from such details may be made without departing from the spirit or scope of the applicant's general inventive concept.

We claim:

1. A gutter broom assembly for a street sweeper, said street sweeper having a vacuum system for moving air through a portion thereof, said gutter broom assembly comprising:

a gutter broom housing coupled to the street sweeper;

a gutter broom coupled to the street sweeper, said gutter broom being selectively movable relative to a ground surface between an operational orientation and a transport orientation;

a skirt assembly attached to the gutter broom housing, said skirt assembly including a plurality of flexible skirt portions which are selectively movable relative to the ground surface, together the gutter broom housing and the skirt assembly define a sweeping chamber which substantially encloses the gutter broom;

a vacuum conduit coupled between the sweeping chamber and the vacuum system, said vacuum conduit for removing dust within the sweeping chamber when the gutter broom is in its operational orientation, and wherein the flexible skirt portions are selectively pivoted relative to the gutter broom housing.

2. A gutter broom assembly for a street sweeper, said street sweeper having a vacuum system for moving air through a portion thereof, said gutter broom assembly comprising:

a gutter broom housing coupled to the street sweeper;

a gutter broom coupled to the street sweeper, said gutter broom being selectively movable relative to a ground surface between an operational orientation and a transport orientation;

a skirt assembly attached to the gutter broom housing, said skirt assembly including a plurality of flexible skirt portions which are selectively movable relative to the ground surface, together the gutter broom housing and the skirt assembly define a sweeping chamber which substantially encloses the gutter broom; a vacuum conduit coupled between the sweeping chamber and the vacuum system, said vacuum conduit for removing dust within the sweeping chamber when the gutter broom is in its operational orientation and wherein the skirt assembly comprises a front skirt, a rear skirt, and at least one side skirt, said side skirt partially adjacent the gutter broom and wherein at least one of the front or rear skirts can be selectively moved relative to the gutter broom housing between an operational orientation and a transport orientation.

3. The gutter broom assembly of claim 2, wherein both the front skirt and rear skirt can be selectively moved relative to the gutter broom housing between an operational orientation and a transport orientation.

4. The gutter broom assembly of claim 3 wherein the front skirt or rear skirts are selectively pivoted relative to the gutter broom housing by operation of a hydraulic actuator.

5. A gutter broom assembly for a street sweeper, said street sweeper having a vacuum system for moving air relative to the street sweeper, said gutter broom assembly comprising:

a gutter broom housing coupled to the street sweeper;

a pair of gutter brooms coupled to the street sweeper, each of said pair of gutter brooms being movable relative to a ground surface between an operational orientation and a transport orientation;

a skirt assembly attached to the gutter broom housing, together the gutter broom housing and skirt assembly defining a sweeping chamber, said skirt assembly including a plurality of selectively movable flexible skirt portions, said sweeping chamber substantially enclosing the pair of gutter brooms; and a vacuum conduit between the sweeping chamber and the vacuum system, said vacuum conduit for removing dust within the sweeping chamber when each of the pair of gutter brooms is in its operational orientation and wherein the flexible skirt portions are selectively pivoted relative to the gutter broom housing.

6. The gutter broom assembly of claim 5, wherein the skirt assembly comprises a front skirt, a rear skirt, and a pair of side skirts, each one of the pair of side skirts being partially adjacent an associated one of the pair of gutter brooms.

7. The gutter broom assembly of claim 6, wherein the front skirt and rear skirt can be lifted relative to the gutter broom frame independently of the side skirt.

8. The gutter broom assembly of claim 5 wherein the flexible skirt portions are selectively pivoted relative to the gutter broom housing by operation of a hydraulic actuator.

9. The gutter broom assembly of claim 5 further comprising a pair of four-bar linkages for coupling the pair of gutter brooms to the street sweeper.

10. A street sweeper comprising:

a vehicle, a vacuum system coupled to the vehicle;

a main cylindrical pickup broom coupled to the vehicle;

a debris collection hopper for receiving debris from the pickup broom;

a gutter broom assembly for engaging debris within a street gutter as the vehicle progresses, said gutter broom assembly comprising:

a gutter broom housing coupled to the vehicle;

a gutter broom coupled to the vehicle, said gutter broom being selectively movable relative to a ground surface between an operational orientation and a transport orientation;

a skirt assembly attached to the gutter broom housing, said skirt assembly including a plurality of flexible skirt portions which are selectively movable relative to the ground surface, together the gutter broom housing and the skirt assembly define a sweeping chamber which substantially encloses the gutter broom; and a vacuum conduit coupled between the sweeping chamber and the vacuum system, said vacuum conduit for removing dust within the sweeping chamber when the gutter broom is in its operational orientation and wherein the flexible skirt portions are selectively pivoted relative to the gutter broom housing by operation of a hydraulic operator.

11. The street sweeper of claim 10, wherein the skirt assembly comprises a front skirt, a rear skirt and at least one side skirt, said side skirt partially adjacent the disk broom.

12. The street sweeper of claim 11, wherein the front skirt, and rear skirt can be lifted relative to the gutter broom frame independently of the side skirt.

13. The street sweeper of claim 10 further comprising a four-bar linkage for coupling the gutter broom to the vehicle.

14. A method of providing vacumized and non vacumized gutter sweeping with a street sweeping vehicle, said street sweeping vehicle including a vacuum system for moving air through a portion thereof, and a gutter broom assembly including a gutter broom housing and a gutter broom being movable relative to the street between an operational orientation and a transport orientation, a skirt assembly pivotally attached to the gutter broom frame and together with the gutter broom housing defining a sweeping chamber, said skirt assembly including a plurality of selectively movable flexible skirt portions, said sweeping chamber substantially enclosing the gutter broom within the sweeping chamber, a vacuum conduit between the sweeping chamber and the vacuum system, said method comprising the steps of: transporting the street sweeping vehicle to a location where gutter sweeping is required, determining if vacuumized gutter sweeping is required and if so lowering the skirt to substantially enclose the gutter broom and activating the vacuum system for simultaneous sweeping and vacuumization of the gutter area;

determining if non vacuumized gutter sweeping is required and if so, raising the skirt to substantially expose the gutter broom and sweeping the gutter area.

* * * * *